United States Patent [19]

Fukuoka et al.

[11] Patent Number: 5,051,012

[45] Date of Patent: Sep. 24, 1991

[54] CARRIAGE POSITIONING FOR MULTIPLE IMPACT PRINTING

[75] Inventors: Mutsuo Fukuoka, Yokkaichi; Norio Kobayashi, Nogoya, both of Japan

[73] Assignee: Brother Kogyo Kabushiki Kaisha, Nagoya, Japan

[21] Appl. No.: 370,638

[22] Filed: Jun. 23, 1989

[30] Foreign Application Priority Data

Jun. 24, 1988 [JP] Japan ..... 63-157695

[51] Int. Cl.[5] ..... B41J 19/32

[52] U.S. Cl. ..... 400/279; 400/303; 400/697; 400/903

[58] Field of Search ..... 400/210, 279, 303, 304, 400/322, 695, 697.1, 903

[56] References Cited

U.S. PATENT DOCUMENTS

| | | | |
|---|---|---|---|
| 4,307,971 | 12/1981 | Kane | 700/304 |
| 4,388,005 | 6/1983 | Wekhing et al. | 700/697 |
| 4,493,570 | 1/1985 | Araki | 700/51 |
| 4,688,956 | 8/1987 | Miyake | 400/279 |
| 4,692,045 | 9/1987 | Makita | 400/304 |
| 4,708,505 | 11/1987 | You | 700/697.1 |

FOREIGN PATENT DOCUMENTS

| | | | |
|---|---|---|---|
| 0289134 | 3/1988 | European Pat. Off. . | |
| PCT8400556 | 11/1984 | Japan | 400/304 |
| 120080 | 6/1985 | Japan | 400/903 |
| 60-198281 | 7/1985 | Japan . | |
| 60-198283 | 7/1985 | Japan . | |
| 147376 | 8/1985 | Japan | 400/304 |
| 198282 | 10/1985 | Japan | 400/304 |
| 123556 | 6/1986 | Japan | 400/903 |
| 242844 | 10/1986 | Japan | 400/304 |
| 242583 | 10/1988 | Japan | 400/697 |
| 2013576 | 10/1978 | United Kingdom . | |
| 2204281A | 5/1988 | United Kingdom . | |

OTHER PUBLICATIONS

Search Report Appln. No. 8914530.4.

*Primary Examiner*—David A. Wiecking
*Assistant Examiner*—Steven S. Kelley
*Attorney, Agent, or Firm*—Kane, Dalsimer, Sullivan, Kurucz, Levy, Eisele and Richard

[57] ABSTRACT

In a printing device capable of executing printing operation in a bold face print mode, provided are means for controlling a carriage so as to be stopped in a predetermined period of time before the first printing operation is executed so that an inconvenient vibration of the carriage is attenuated, and means for executing a plurality of printing operations included in a bold-face print after the vibration is sufficiently attenuated.

Thus, qualities of the printed characters in the bold-face print mode are extremely uniform with each other.

15 Claims, 12 Drawing Sheets

( TP: TWO - PHASE )

(TP : TWO - PHASE
OP : ONE - PHASE)

CARRIAGE POSITIONING FOR MULTIPLE IMPACT PRINTING

BACKGROUND OF THE INVENTION

This invention relates to a printing device provided with a function for printing and correcting character in bold face and the like by printing the characters in an overlapping state, more particularly, to a printing device having a function capable of attenuating an inconvenient vibration of a carriage at a printing position.

As shown in FIG. 1, a conventional printing device being excited and controlled two-two phase excitation provided with a function for printing character in bold face and the like employs such a printing method that a first print 1P is carried out when a carriage is stopped at a first stop position 1S (a two-phase exciting position of a step motor which reciprocates the carriage along a print line of a print sheet to be printed thereon), a second print 2P is carried out when the carriage is stopped at a second stop position 2S (an one-phase exciting position of the step motor), then a third print 3P is carried out when the carriage is stopped at a third stop position 3S (an one-phase exciting position of the step motor) which is symmetrical to the second stop position 2S about the first stop position 1S, and further a fourth print 4P is carried out at the same position as the third stop position 3S.

However, it is necessary for finely moving the carriage to employ a high-quality step motor having a high resolution, or general purpose step motor having an ordinary resolution with a large gear ratio for transmitting a drive power from the step motor to the carriage. Therefore, in a prior art, it is difficult to make the printing device inexpensive or to minimize a carriage driving system.

It may be considered that an one-two phase excitation operation is applied to the general purpose step motor for finely moving the carriage. A problem described later, however, may be occured by means of a difference of a torque value between a one-phase excitation and two-phase excitation when the one-two phase excitation operation is applied to the general purpose step motor as it is, it has not been applied for controlling the carriage so as to move finely in a bold-face print and a cerrection print operation.

If the above one-two phase excitation is applied when the bold-face print are executed, the problem described below may be occured.

When the carriage traveling at a high speed stops abruptly at the first stop position 1S to carry out the first print 1P, this printing operation is carried out while the carriage vibrates at the first stop position and thus the first print position may be dislocated. In addition, when the carriage is moved to the second print position by exciting an one-phase of the step motor after the first printing operation is finished, the carriage remains vibrated by the printing operation effected for the first print. Because the carriage can not be accurately moved to the second print position by the driving force produced by exciting the one-phase having smaller torque, the printing device has a problem in that a gap is caused between a first dint and second dint respectively printed by the first and second printing operation, the character is made very thick, or conversely it is made very thin.

SUMMARY OF THE INVENTION

It is therefore an object of the invention to make the printing device inexpensive, while to minimize the carriage driving system. As a result, the whole printing device is simply designed and minimized.

It is therefore another object of the invention to provide an improved printing device having a function capable of attenuating an inconvenient vibration of a carriage, in a bold face type mode, so that a thickness of the printed character is not extremely varied to enable uniform and beautiful printing of the character.

For this purpose, according to this invention there is provided a printing device comprising input means for inputting character data, a print head member movable along a print line on a print sheet for executing print operations in response to the inputted character data, and print mode changing means for changing print modes between a normal print mode for executing a print operation in an original form of a character and at least a bold face print mode for executing a print operation in a bold face form, the printing device further comprises: a step motor for reciprocating the print head member along the print line on the print sheet, the step motor being excited in one-two phase excitation in case that the bold-face print mode is designated by the print mode changing means; first control means for controlling the step motor, when the bold-face print mode is designated by the print mode changing means, so as to place the print head member at a first stop position corresponding to a certain two-phase exciting position of the step motor in a predetermined period of time, and then to move the print head member to a first print position corresponding to an one-phase exciting position adjacently located from the two-phase exciting position; and second control means for controlling the print head member so as to execute a print operation at the first print position.

DESCRIPTION OF THE ACCOMPANYING DRAWINGS

Figure 5A:
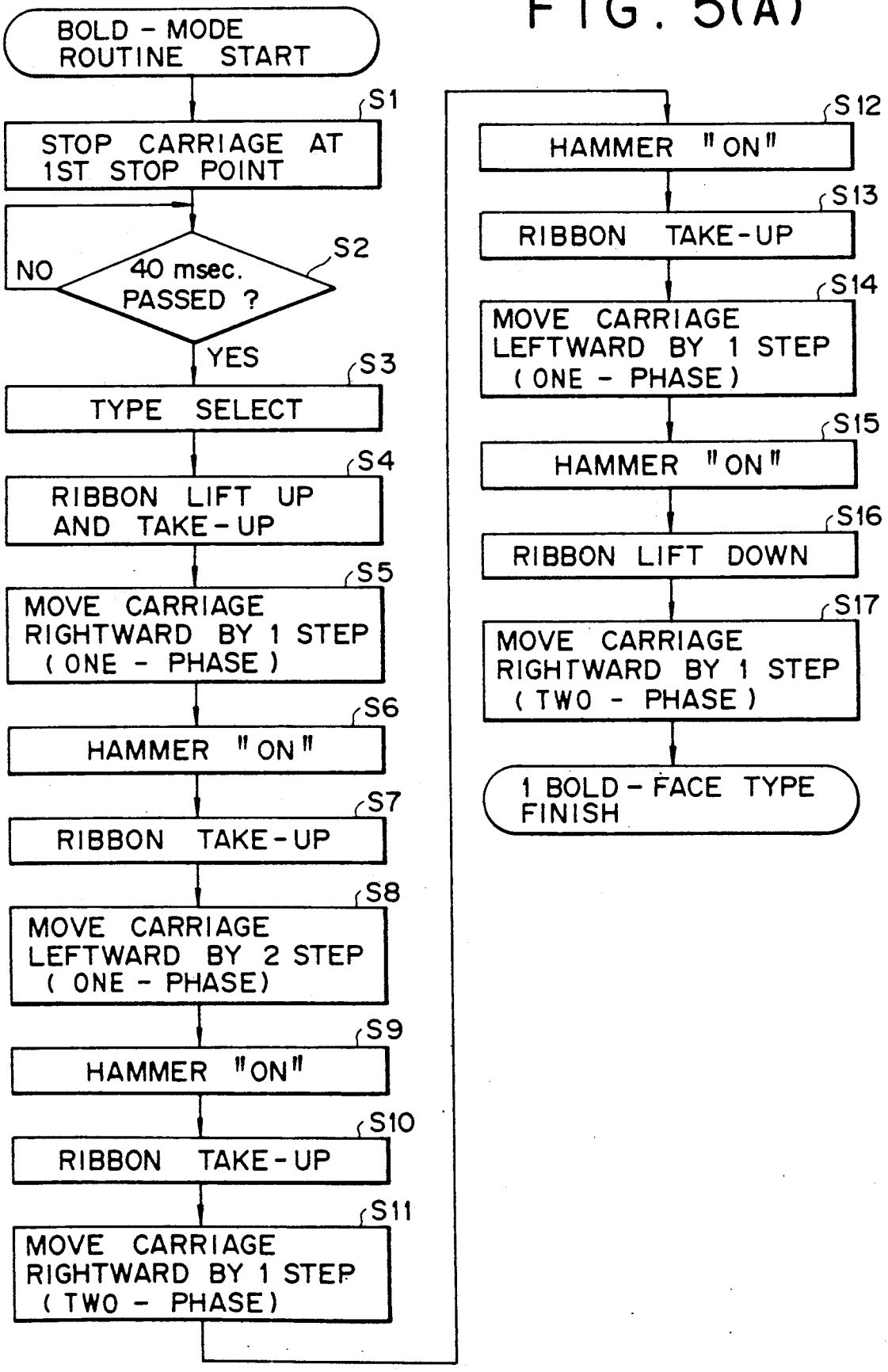
Figure 5B:
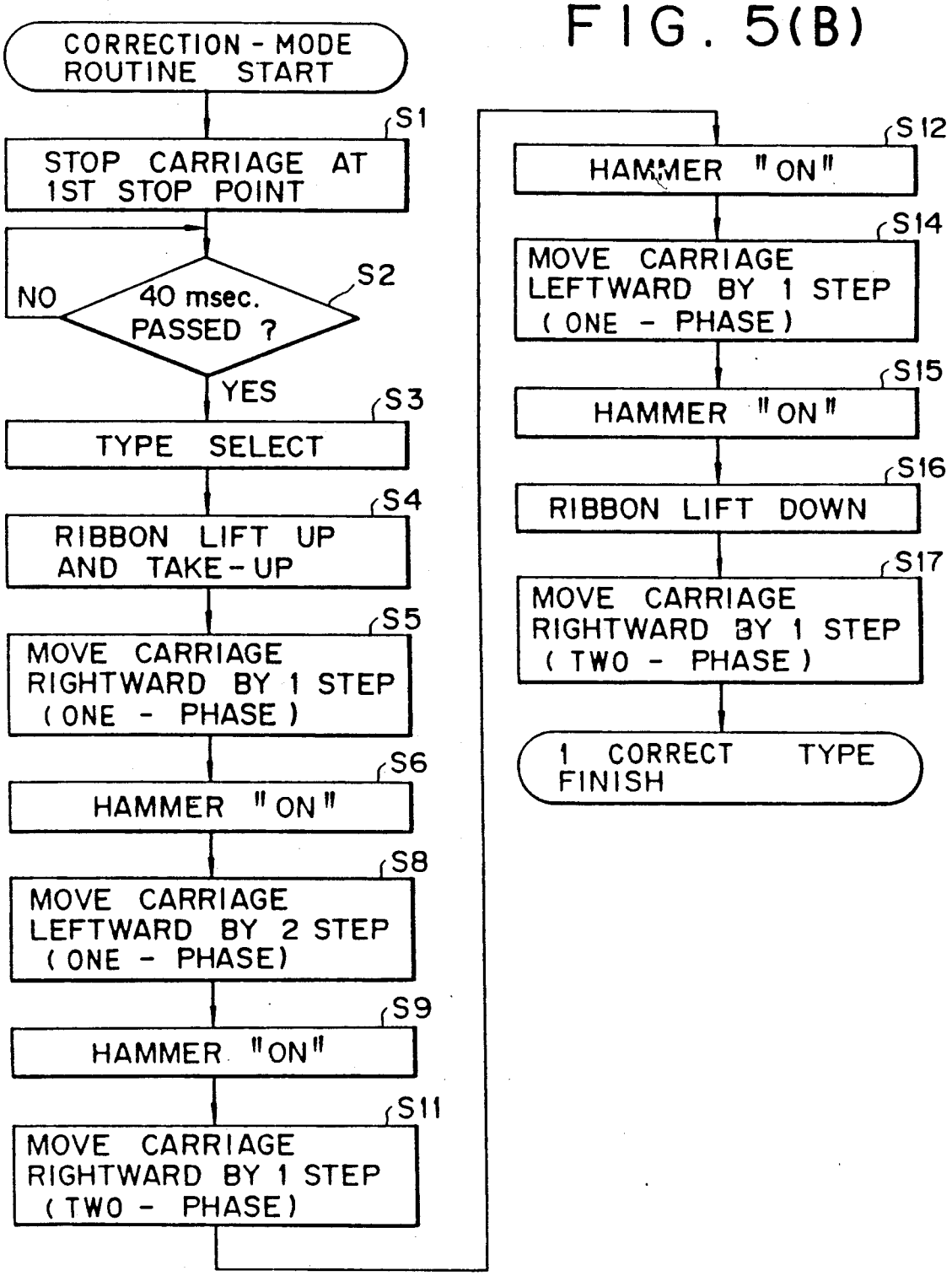
Figure 6:
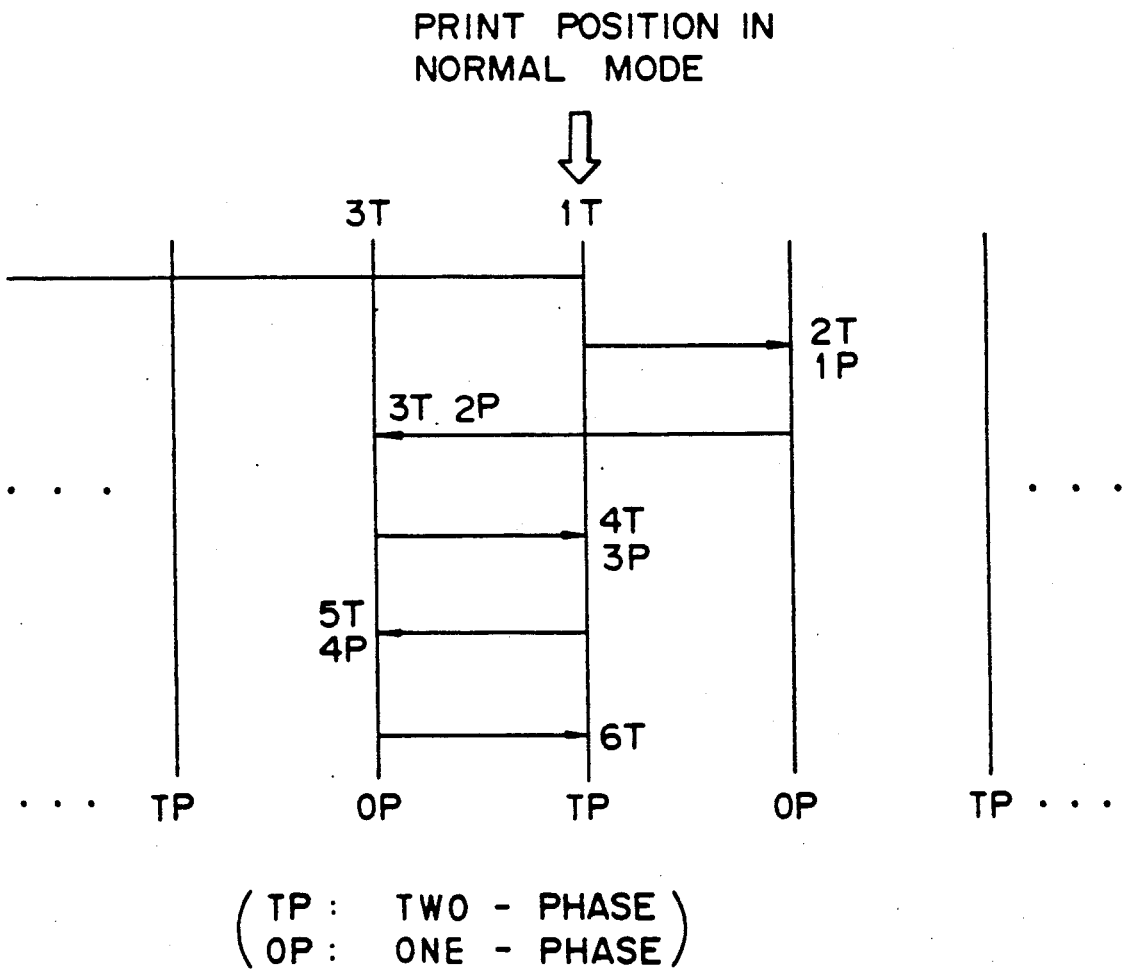
Figure 7:
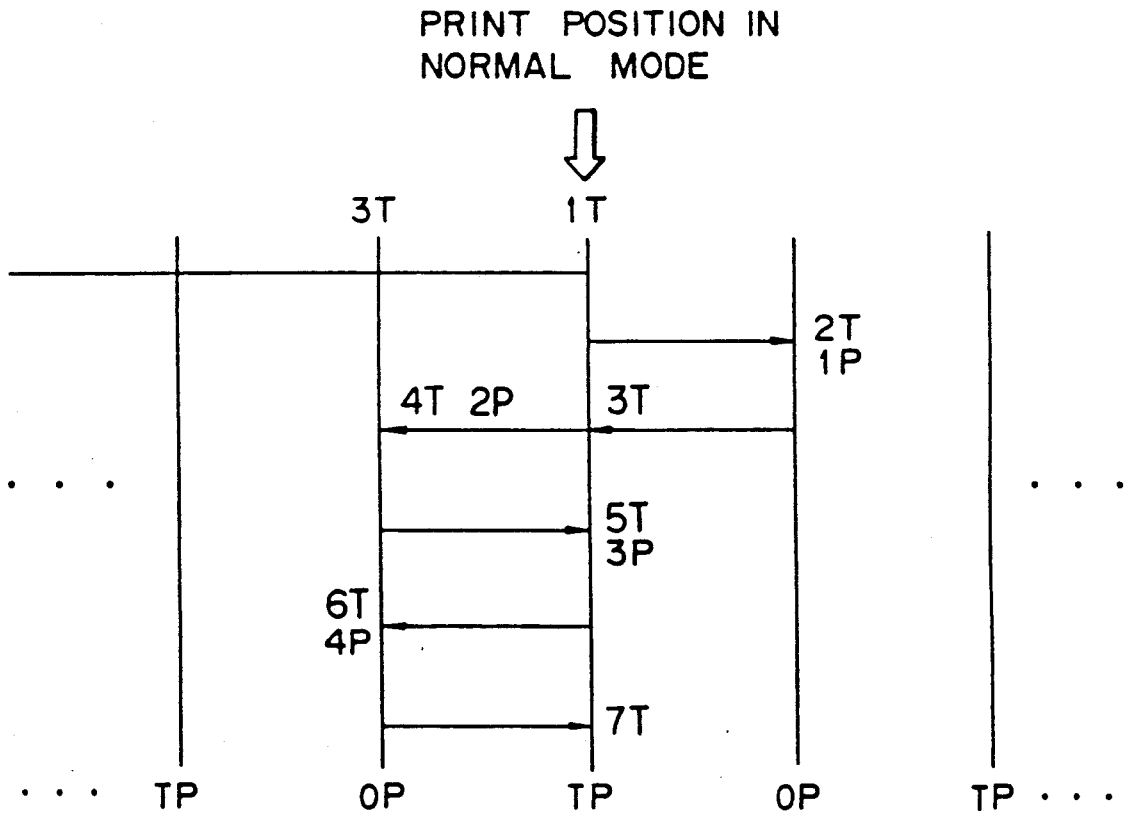
Figure 8:
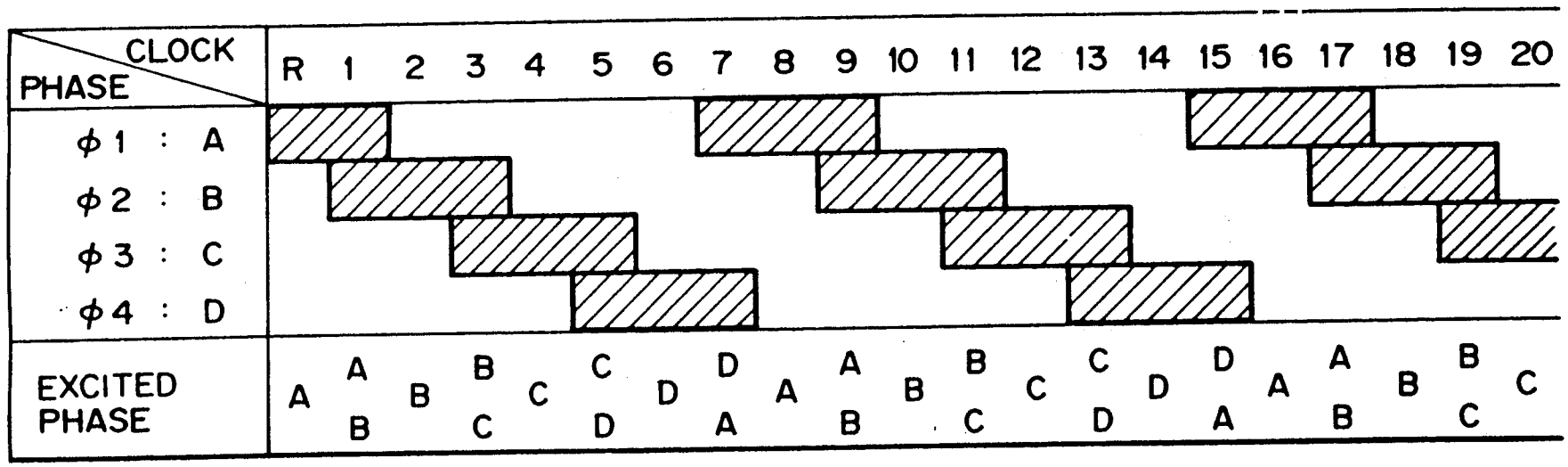
Figure 9:
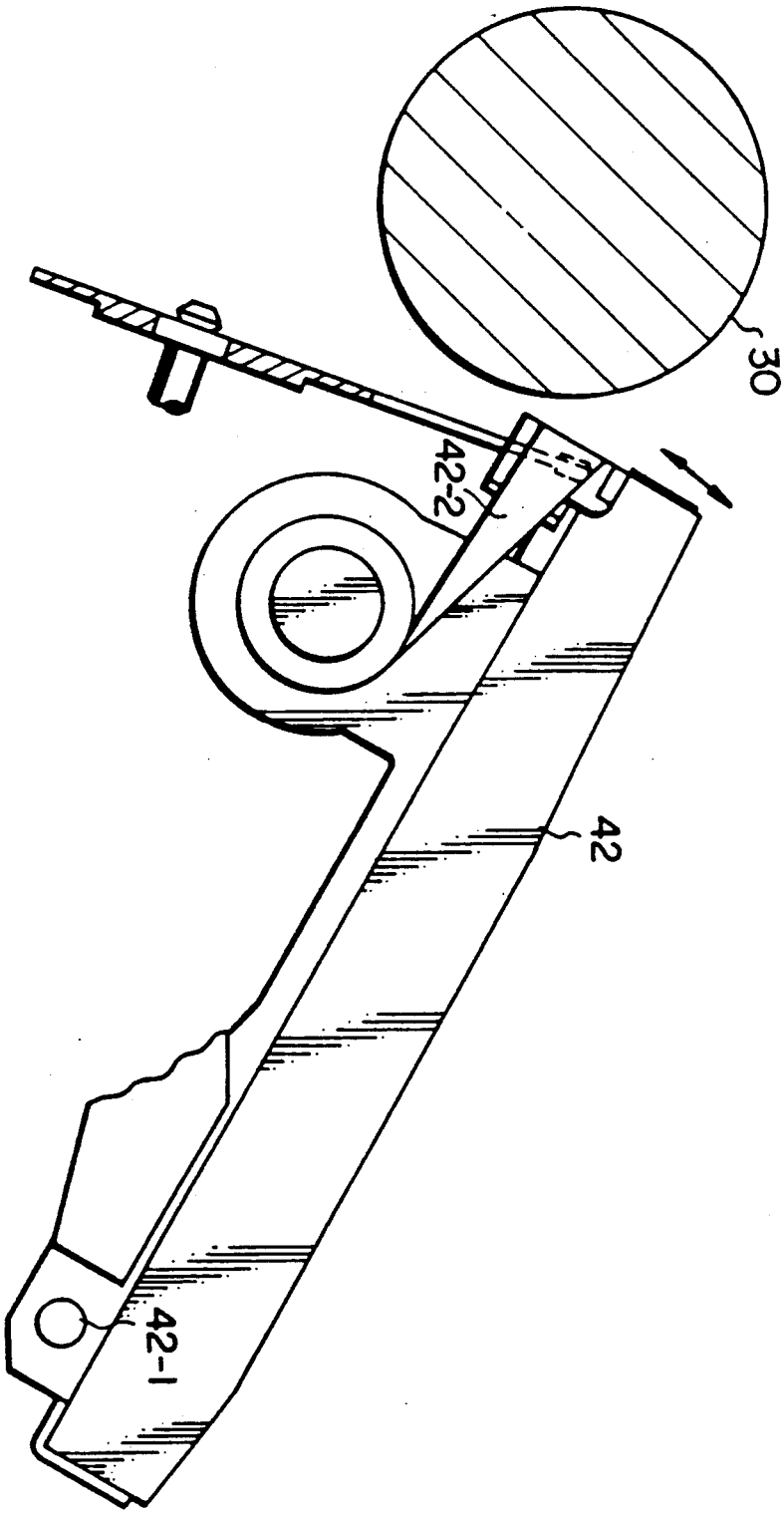

FIG. 5(A) and (B) are flowcharts respectively showing a bold-face print mode and correction mode routine executed by the printing device according to the invention;

FIG. 6 is a diagram explanatory of the movement of a carriage when a printing operation is effected in a bold face print mode with the carriage applied one embodiment of the present invention;

FIG. 7 is a diagram explanatory of the movement of a carriage when a printing operaiton is effected in a bold face print mode with the carriage applied another embodiment of the present invention;

FIG. 8 is a sequence diagram of the excitation of a step motor for horizontally reciprocating the carriage;

FIG. 9 is a view explanatory of the movement of a ribbon holder provided in the carriage.

Figure 10:
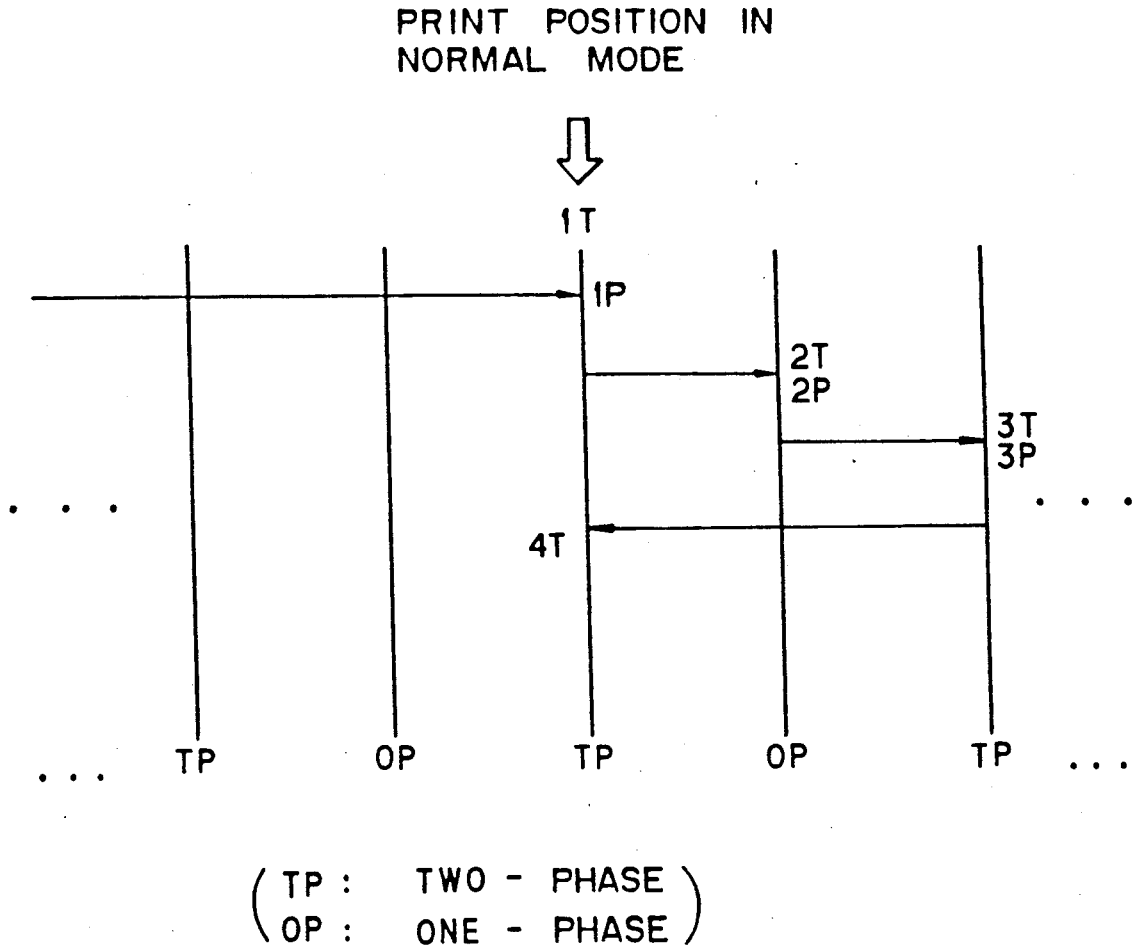
Figure 11:
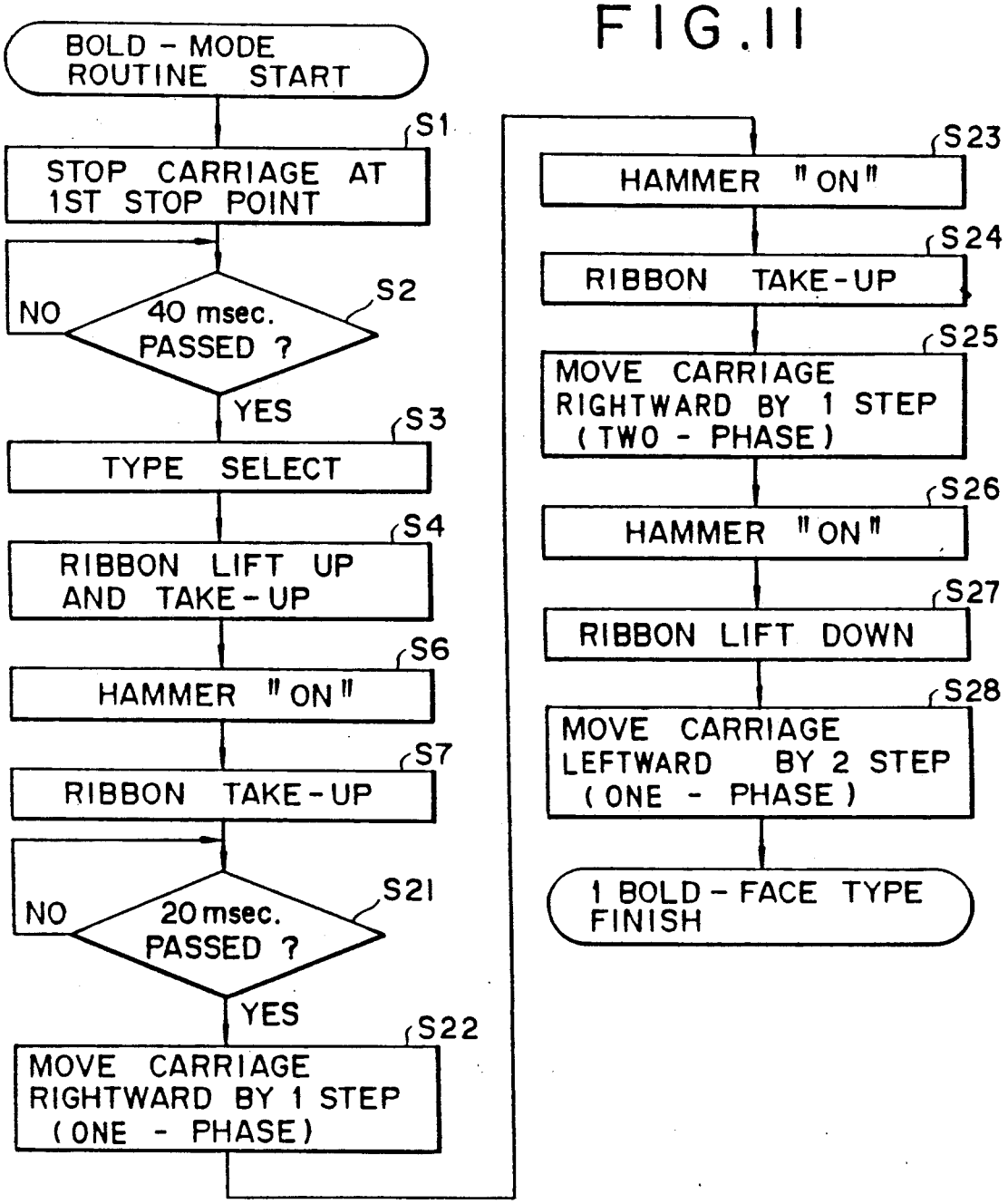

FIG. 10 is a diagram explanatory of the movement of a carriage when a printing operation is effected in a bold-face print mode with the carriage applied another embodiment of the present invention; and FIG. 11 is a flowchart showing a bold-face print mode routine executed by the printing device according to the invention with another embodiment.

DESCRIPTION OF THE EMBODIMENTS

An embodiment of the present invention applied to an electronic typewriter will be described with reference to drawings.

Figure 1:
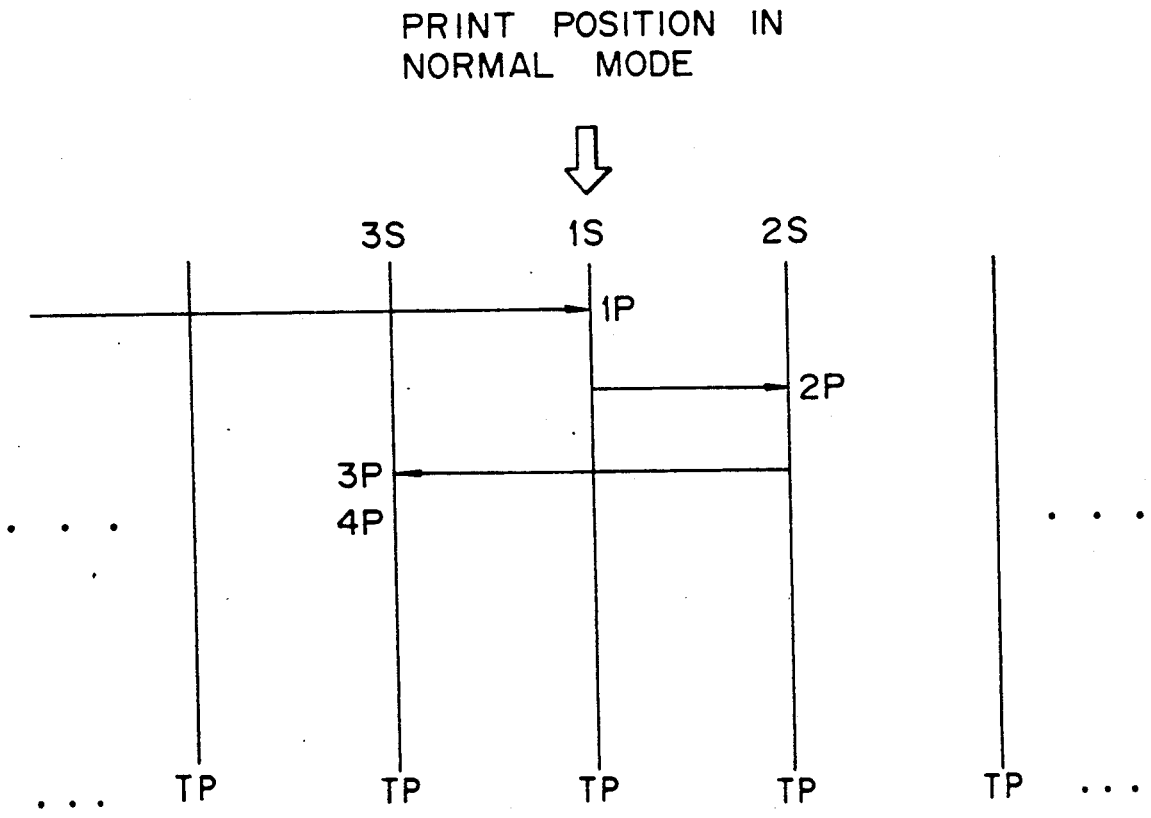
FIG. 1 (PRIOR ART)
FIG. 1 is a diagram explanatory of a movement of a carriage when a printing operation is effected in a conventional bold-face print mode.
Figure 2:
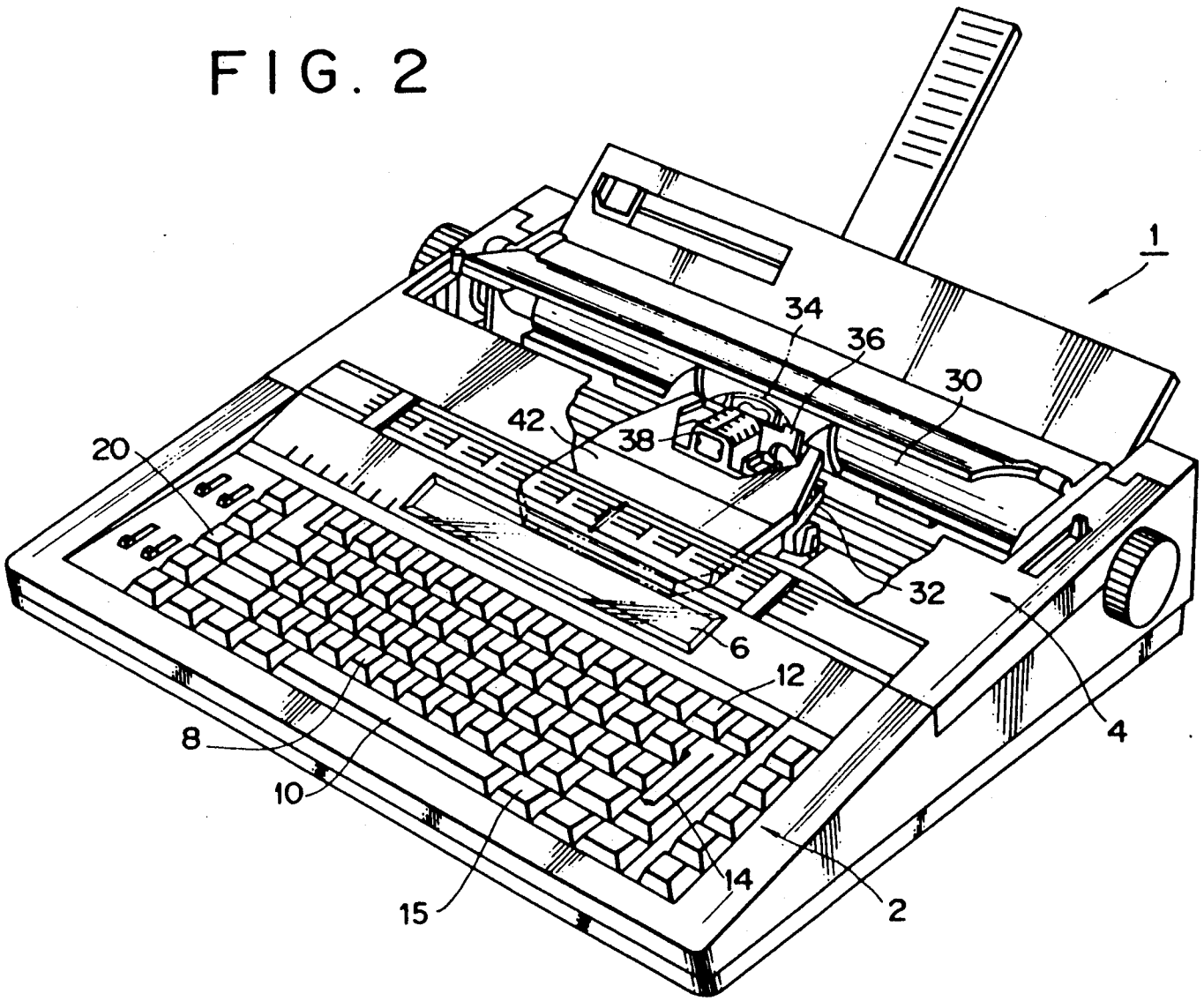
FIG. 2 is a perspective view of an electronic typewriter incorporating a printing device according to the present invention.

FIG. 2 shows an electronic typewriter 1 comprising a keyboard 2, a print mechanism 4 and a liquid crystal display panel o having the prescribed line numbers interposed therebetween. The keyboard 2 is provided with many keys such as character keys 8 including letter keys, numeral keys, symbol keys and the like for inputting character data in response to the characters, and function keys such as a space key 10 for moving a carriage 32, described later, by one digit to the right, a backspace key 12 for moving the carriage 32 by one digit leftward, a return key 14 for moving the carriage 32 to the left end and executing a line feed operation, a correction key 15 for erasing a character having been wrongly printed, a bold mode setting key 20 for setting a bold-face print mode and the like.

The print mechanism 4 is provided with a platen 30 also serving as a sheet feed roller and the carriage 32 moving along this platen 30. The carriage 32 includes a wheel cassette 36 for accommodating a type wheel 34, a print hammer with a solenoid for driving it 38, a ribbon cassette 42 for accommodating a print ribbon and the like mounted thereon. In a usual print mode, after a type corresponding to a key input is selected by the rotation of the type wheel 34 and a print is effected on a print sheet by the strike of the print hammer, the carriage 32 is moved by a single character pitch, whereas when the bold mode setting key 20 is depressed to set a bold face print mode, the carriage 32 is slightly moved by a carriage drive step motor 104 to be described later.

Figure 3:
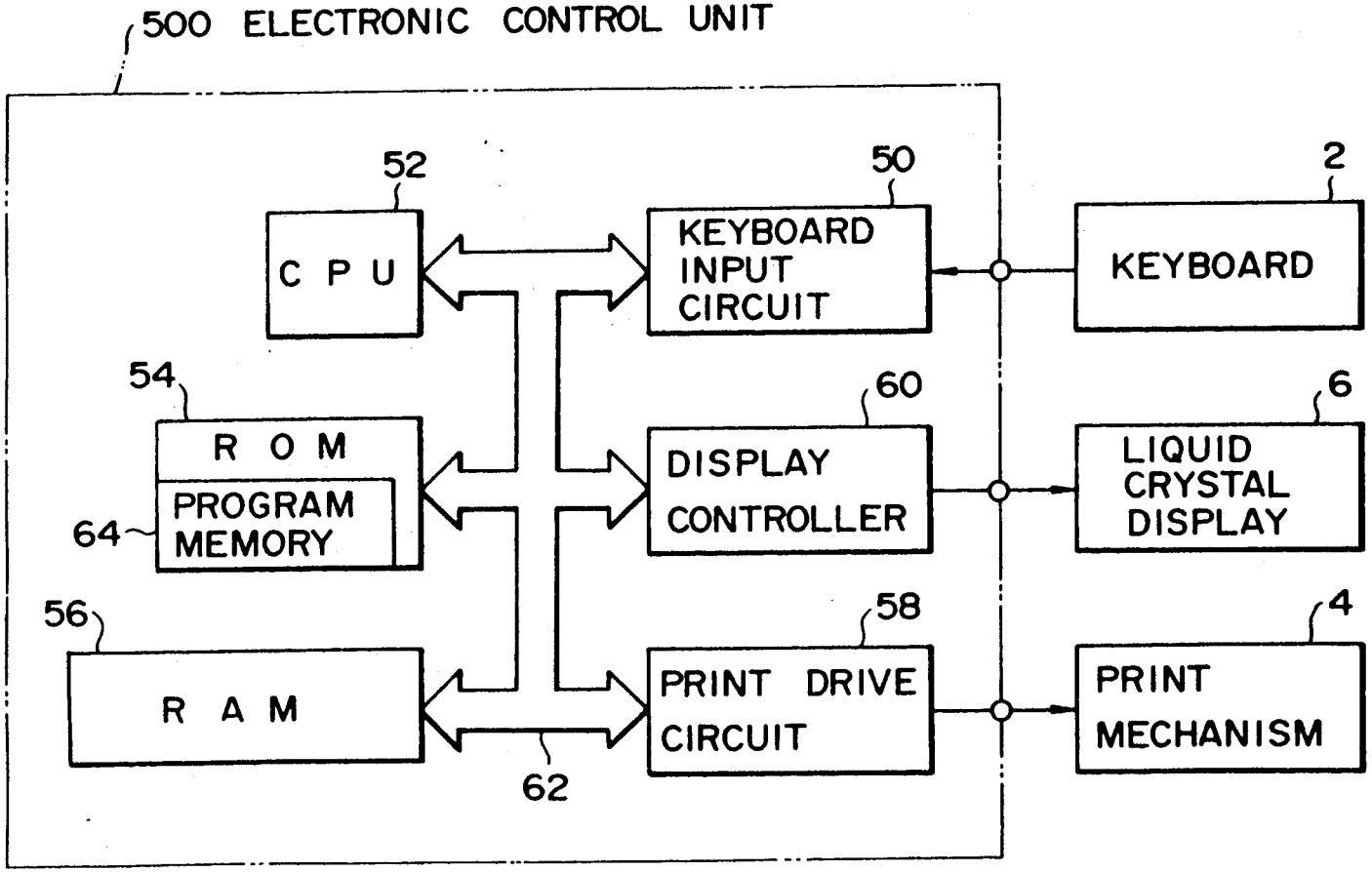
FIG. 3 is a block diagram of the control of the electronic typewriter of FIG. 2.

An electronic control unit 500 of the electronic typewriter 1 will be described with reference to a block diagram of FIG. 3.

The keyboard 2 is electrically connected with a known CPU (Central Processing Uuit) 52 via a keyboard input circuit 50 and a code corresponding to a key depressed through the keyboard 2 is transmitted to the CPU 52. The CPU 52 is electrically connected with a ROM (Read Only Memory) 54, a RAM (Random Access Mmemory) 56, a print drive circuit 58 and a display controller 60 in addition to the keyboard input circuit 50 via common bus line 62. The bus line 62 also connects these components with each other.

The ROM 54 includes a control program for controlling an overlapping print of bold characters and the like effected by the electronic typewriter 1 and a program memory 64 for storing various control programs. The RAM 56 includes a buffer, a register, a counter and the like necessary for various controls of the typewriter 1.

Figure 4:
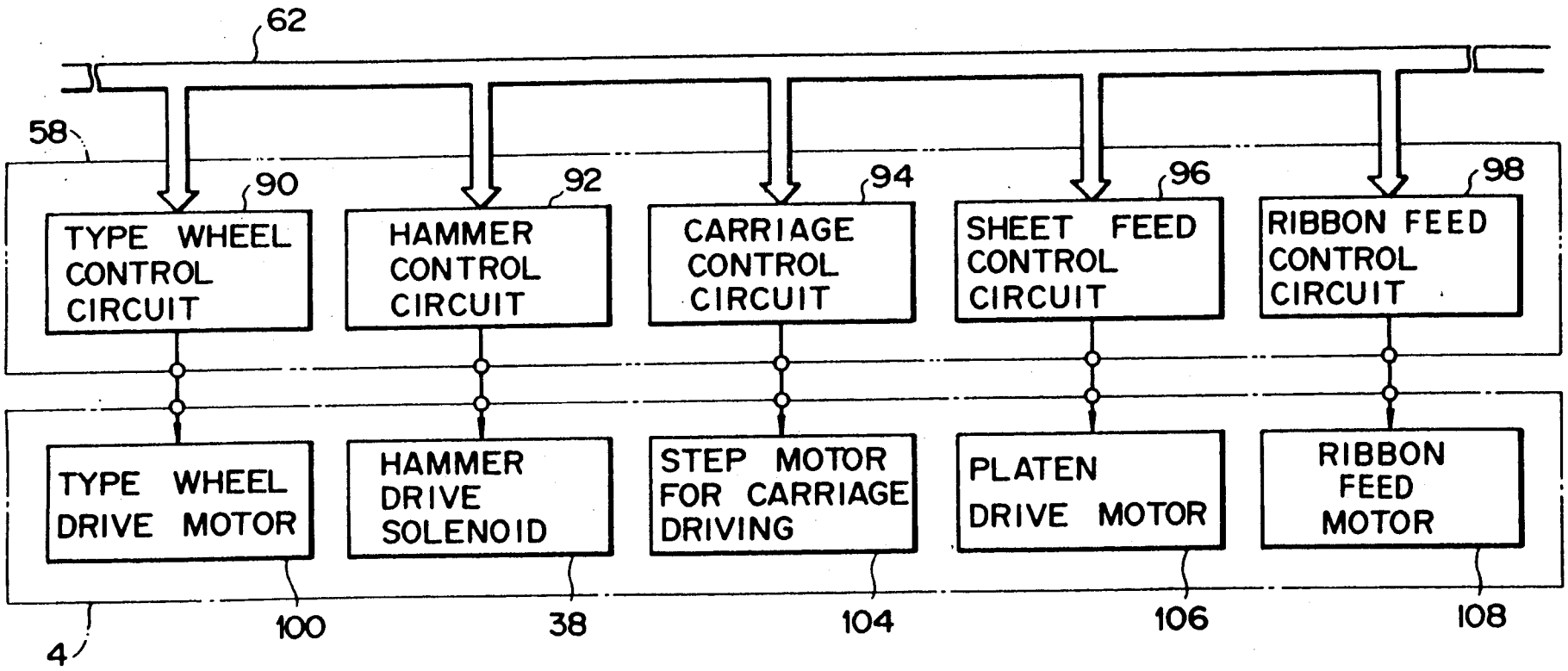
FIG. 4 is a block diagram of the printing operation control of the electronic typewriter of FIG. 2.

The print drive circuit 58 controls the actuation of the carriage 32 and the type wheel 34 based on a carriage moving signal and a type selection signal in accordance with a character to be printed which are applied from the CPU 52. As shown in FIG. 4, the print drive circuit 58 comprises a type wheel control circuit 90, a hammer control circuit 92, a carriage control circuit 94, a sheet feed control circuit 96 and a ribbon feed control circuit 98. The above respective circuits control the actuation of a type wheel drive motor 100, a hammer drive solenoid 38, a carriage drive step motor 104, a platen drive motor 106 and a ribbon feed drive motor 108 which compose the drive system of the print mechanism 4.

The operation of the electronic typewriter 1 for printing bold characters will be described below with reference to FIG. 5 through FIG. 8. FIG. 8 is a sequence diagram of the excitation of a 4-phase step motor used as the step motor for carriage driving 104 and shows that a first phase $\phi 1$ (referred to as a phase A) of the four phases of the step motor is excited at the timing of a clock (drive pulse) R. Likewise, the first phase $\phi 1$ and a second phase $\phi 2$ (phase A and phase B) are excited at the timing of a clock 1, only the phase $\phi 2$ is excited at the timing of clock 2, the second phase $\phi 2$ and a third phase $\phi 3$ (phase B and phase C) are excited at the timing of a clock 3, only the third phase $\phi 3$ is excited at the timing of a clock 4, the third phase $\phi 3$ and a fourth phase $\phi 4$ (phase C and phase D) are excited at the timing of a clock 5, and only the fourth phase $\phi 4$ is excited at the timing of a clock 6. Then, FIG. 8 shows that the fourth phase and the first phase (phase D and phase A) are excited at the timing of a clock 7 and the same excitation sequence as above will be repeated at the timing of a clock 8 and thereafter. In FIG. 6, an one-phase (single phase) excitation position of the step motor corresponds to the step position of the even clock timings such as R, 2, 4, 6, 8, 10, 12, 14, 16, 18, 20 and the like in FIG. 8 where an one-phase is excited; and a two-phase (double-phase) excitation position corresponds to the step position of the odd clock timings such as 1, 3, 5, 7, 9, 11, 13, 15, 17, 19 and the like in FIG. 8 where two phases adjacently located are excited.

A bold character print control effected by the CPU 52 will be described below with reference to a bold mode routine flow chart of FIG. 5.

When the bold mode setting key 20 is depressed and the electronic typewriter 1 is set to the bold-face print mode, character set by the character key 8 is displayed on the liquid crystal panel 6. Then, as shown in a flow STEP S1 (referred to as S1, S2 . . . , hereinafter), after the carriage 32 is moved to a first stop position 1T (the two-phase excitation position of the step motor) shown in FIG. 6 and stopped there by the carriage drive step motor 104 (referred to as a step motor, hereinafter), if the carriage 32 is stopped for 40 msec. or more at the first stop position 1T is determined at S2. If the carriage 32 is stopped for 40 msec. or more, i.e., if it is determined that a prescribed period of time necessary to enable the damping of the carriage 32 to be terminated has elasped, a process goes to S3 where the type wheel drive motor 100 is driven to select a character to be printed. At S4, the ribbon feed drive motor 108 is driven to lift a ribbon to a print position and wind up the same, and them at S5 the step motor 104 is turned clockwise by an amount of a single step to slightly move the carriage 32 to the right. As result, the carriage 32 is stopped at a second stop position 2T (i.e. a first print position) corresponding to a single phase excitation position of the step motor 104 and a first print 1P is effected by a hammer actuated by the hammer drive solenoid 38 at the second stop position 2T at S6 and then the ribbon is wound at S7. Next, the process goes to S8 where the step motor 104 is turned counterclockwise by an amount of two steps to move the carriage 32 to the left and stop the same at a third stop position 3T (i.e. a second print position) corresponding to a one-phase excitation position of the step motor 104.

When the carriage 32 is stopped at the third stop position 3T, the hammer is actuated at S9 to effect a second print 2P and the ribbon is wound at S10. Next, the process goes to 11 where the step motor 104 is turned clockwise by an amount of a single step to move the carriage 32 to the right and stop the same at a fourth stop position 4T (i.e. a third print position) corresponding to a two-phase excitation position fo the step motor 104. When the carriage 32 is stopped at the fourth stop position 4T, the hammer is actuated to effected a third print 3P at S12 and the ribbon is wound at S13. Next the process goes to S14 where the step motor 104 is turned counterclockwise by an amount of a single step to move the carriage 32 to the left and stop the same at a fifth stop position 5T (i.e. a fourth print position) corresponding to a one-phase excitation position of the step motor 104. When the carriage 32 is stopped at the fifth stop position 5T, the hammer is actuated to effect a fourth print 4P at S15 and the ribbon is lowered from the print position to a rest position at S16. Next, the process goes S17 where the step motor 104 is turned clockwise by an amount of a single step to move the carriage 32 to the right and stop the same at a sixth stop position 6T corresponding to two phase excitation position of the step motor 104, whereby the print of the bold character set by the character key 8 is finished and process goes to the step of the next printing operation. After the processings S8, S11 and S14, not shown, the print hammer is so arranged not to be drived till the vibration of the carriage is sufficiently attentuated.

With the control as described above, since the carriage effects the first print 1P after it is slightly moved to the first print position on the termination of the damping thereof at the first stop position 1T, a gap or an irregular thickness of the bold character printed in the bold face print mode can be prevented.

Further, while the carriage 32 is moved from the first print position 1P to the second print position 2P without being stopped at the first stop position 1T in the above embodiment, the quality of printed character is more improved when it is moved to the second print position 2P after it is stopped at the first stop position 1T for a prescribed period of time, as shown in FIG. 7. Further, it may be considered that above each printing operations are executed not only with a printing ribbon but also with a correction ribbon. In this case, as shown in FIG. 9, the ribbon cassette 42 is able to be vertically movable, in response to a changing of a mode, in a direction shown by an arrow about a shaft 42-1 provided in parallel to the platen 30, so that the printing operation are able to be executed with a correction ribbon 42-2. In a correction mode in which the print operations are executed with the correction ribbon 42-2, since a take-up operation is executed by means of an up-down operation of the ribbon cassette 42, the correction ribbon 42-2 is not taken-up in each driving operation of the hammer for saving a time for whole printing operation. Accordingly, the print operation with the correction ribbon 42-2 is executed by a flowchart shown in FIG. 5(B).

Furthermore, as shown in FIG. 10 and FIG. 11, it may be considered that the carriage 32 is moved in one direction. In FIG. 11, the carriage is stopped in 20 msec. in S21 after a driving operation of the hammer is executed so that a vibration of a hammer driving is sufficiently attenuated. The STEP S21 is corresponding to the STEP S2 of FIG. 5.

Accordingly, in the present invention, the carriage 32 is moved to certain one-phase excitation position at which a printing operation including a correction operation is executed, after the carriage 32 is accurately located at the two-phase excitation position adjacently located from the one-phase excitation position.

What is claimed is:

1. A printing device comprising input means for inputting character data, a print head member movable along a print line on a print sheet for executing print operations in response to the inputted character data, and print mode changing means for changing print modes between a normal print mode for executing a print operation in an original form of a character and at least a bold face print mode for executing a print operation in a bold face form, said printing device further comprises:

a step motor for reciprocating said print head member along the print line on the print sheet, said step motor being excited alternately in one or two phases in case that the bold-face print mode is designated by said print mode changing means;

first control means for controlling said step motor, when the bold-face print mode is designated by said print mode changing means, so as to place said print head member at a first stop position corresponding to a certain two-phase exciting position of said step motor for a predetermined period of time without printing, and then to move said print head member to a first print position corresponding to an one-phase exciting position adjacently located to said two-phase exciting position; and second control means for controlling said print head member so as to execute a first print operation at said first print position.

2. The printing device according to claim 1 wherein said first control means further controls said step motor so as to sequentially move said print head member from said first print position, to (1) a second print position corresponding to an one-phase exciting position located at a symmetrical position to said first print position about said first stop position; (2) to said first stop position, and to (3) said second print position, and wherein said second control means further controls said print head member so as to execute print operations at each of said aforementioned positions (1) (2) and (3) where said print head member is placed by said first control means.

3. The printing device according to claim 1 wherein said step motor is a 4-phase step motor.

4. The printing device according to claim 1 wherein said predetermined period of time is longer than 40 msec.

5. The printing device according to claim 2 wherein said first control means further control said step motor so as to place said print head member at said first stop position for another predetermined period of time as said print head member is moved from said first print position to said second print position.

6. The printing device according to claim 1 wherein said second control means further controls said print head member so as to execute a print operation at said first stop position after said first print operation.

7. The printing device according to claim 6 wherein said first control means further controls said step motor so as to place said print head member at a two-phase exciting position adjacently located from said first print position, and wherein said second control means further controls said print head member so as to execute a print operation at said position at which said print head member is located by said first control means.

8. A printing device comprising input means for inputting character data, a print head member movable along a print line on a print sheet for executing print operations in response to the inputted character data, and print mode changing means for changing print modes between a normal print mode for executing a print operation in an original form of a character and at least correction mode for executing a correct operation of the printed characters with a correction ribbon, said printing device further comprises:

a step motor for reciprocating said print heau member along the print line on the print sheet, said step motor being excited alternately in one or two phases in case that the correction mode is designated by said print mode changing means;

first control means for controlling said step motor, when the correction mode is designated by said print mode changing means, so as to place said print head member at a first stop position corresponding to a certain two-phase exciting position of said step motor for a predetermined period of time without printing, and then to move said print head member to a first print position corresponding to an one-phase exciting position adjacently located from said two-phase exciting position; and second control means for controlling said print head member so as to execute a first correct operation at said first print position.

9. The printing device according to claim 8 wherein said first control means further controls said step motor so as to sequentially move said print head member from said first print position, to a second print position corresponding to an one-phase exciting position located at the symmetrical position to said first print position about said first stop position, to said first stop position, and to said second print position, and wherein said second control means further controls said print head member so as to execute correct operations at each positions where said correct head member is placed by said first control means.

10. The printing device according to claim 9 wherein said first control means further control said step motor so as to place said print head member at said first stop position in an another predetermined period of time as said print head member is moved from said first print position to said second print position.

11. The printing device according to claim 8 wherein said second control means further controls said print head member so as to execute a correct operation at said first stop position after said first correct operation.

12. The printing device according to claim 11 wherein said first control meand further controls said step motor so as to place said print head member at a two-phase exciting position adjacently located from said first print position, and wherein said second control means further controls said print head member so as to execute a correct operation at said position at which said print head member is located by said first control means.

13. A printing device comprising input means for inputting character data, a print head member movable along a print line on a print sheet for executing print operations in response to the inputted character data, and print mode changing means for changing print modes between a normal print mode for executing a print operation in an original form of a character and at least a bold face print mode for executing a printing operation in a bold face form, said printing device further comprises:

a step motor for reciprocating said print head member along the print line on the print sheet, said step motor being excited alternately in one or two phases in case that the bold-face print mode is designated by said print mode changing means;

first control means for controlling said step motor, when the bold-face print mode is designated by said print mode changing means, so as to place said print head member at a first stop position corresponding to a certain two-phase exciting position of said step motor for a predetermined period of time without printing, and thereafter to move said print head member to a second stop position corresponding to a one-phase exciting position adjacently located from said two-phase exiting position and;

second control means for controlling said print head member so as to execute a first print operation at said second stop position.

14. The printing device according to claim 13 wherein said second control means further controls said print head to execute said first print operation when said print head is at said first stop position.

15. The printing device according to claim 14 wherein said first control means controls said step motor so as to hold said print head at said first stop position for a second predetermined period of time after said first print operation prior to moving said print head member to said second stop position.

* * * * *